US007434700B2

(12) United States Patent
Kao

(10) Patent No.: US 7,434,700 B2
(45) **Date of Patent: *Oct. 14, 2008**

(54) SUSPENDING DEVICE FOR SCREWDRIVERS

(76) Inventor: Jui-Chien Kao, No. 358, Tunghsing Rd., Shuwang Li, Tali City, Taichung Hsien (TW)

( * ) Notice: Subject to any disclaimer, the term of this patent is extended or adjusted under 35 U.S.C. 154(b) by 325 days.

This patent is subject to a terminal disclaimer.

(21) Appl. No.: 11/134,324

(22) Filed: May 23, 2005

(65) Prior Publication Data

US 2006/0261018 A1 Nov. 23, 2006

(51) Int. Cl.
*A47F 7/00* (2006.01)

(52) U.S. Cl. ..... 211/70.6; 211/4; 211/60.1; 206/372; 206/464

(58) Field of Classification Search ..... 211/60.1, 211/70.6, 13.1, 69, 69.1, 85.26, 85.29, 113, 211/118; 206/349, 372
See application file for complete search history.

(56) References Cited

U.S. PATENT DOCUMENTS 2,161,855 A * 6/1939 Copell ..... 248/316.7
2,371,433 A * 3/1945 Davis ..... 211/70.6
5,515,969 A * 5/1996 Schonenbach ..... 206/373
5,988,382 A * 11/1999 Ritchie et al. ..... 206/372
6,092,655 A * 7/2000 Ernst ..... 206/378
6,378,700 B1 * 4/2002 Tong ..... 206/376
6,474,481 B1 * 11/2002 Liu ..... 211/69
6,685,018 B1 * 2/2004 Chuan ..... 206/373
6,834,767 B1 * 12/2004 Lin ..... 211/70.6
6,955,259 B1 * 10/2005 Jesse ..... 206/366

* cited by examiner

*Primary Examiner*—Katherine Mitchell
*Assistant Examiner*—Jeremy C Ramsey
(74) *Attorney, Agent, or Firm*—Rabin & Berdo, P.C.

(57) ABSTRACT

A suspending device for screwdrivers has a suspending rod and multiple sliders. The suspending rod has two holes defined through the suspending rod respectively near two ends of the suspending rod. The sliders are slidably attached to the suspending rod. Each slider has a holder, two clamping arms and a holding bore. The clamping arms respectively extend from top edge and bottom edge of the holder and respectively engage with top edge and bottom edge of the supporting rod. The holding bore is defined through the holder to hold a shank of a screwdriver. Accordingly, the suspending device can fit with different types of screwdrivers and is versatile in use.

3 Claims, 6 Drawing Sheets

SUSPENDING DEVICE FOR SCREWDRIVERS

BACKGROUND OF THE INVENTION

1. Field of the Invention

The present invention relates to a suspending device, and more particularly to a suspending device for screwdrivers and that is adjustable for different types of screwdrivers and is versatile in use.

2. Description of Related Art

To support and to display screwdrivers, a conventional suspending panel is provided and substantially comprises a panel multiple clamping elements and at least one holding bar detachably attached to the panel and corresponding to the clamping elements. With the arrangement of the clamping elements and the holding bar, screwdrivers can be securely held on the panel for display, such as in a retail store.

However, the clamping elements are integrally formed on the panel and are not adjustable in position, such that the conventional suspending panel cannot fit with different types of screwdrivers and is not versatile in use. Therefore, manufacturers must design and make multiple different suspending panels to fit with different types of screwdrivers, so that the cost for manufacturing the conventional suspending panel is excessively high.

To overcome the shortcomings, the present invention tends to provide a suspending device to mitigate or obviate the aforementioned problems.

SUMMARY OF THE INVENTION

The main objective of the invention is to provide a suspending device for screwdrivers and that can fit with different types of screwdrivers and is versatile in use. The suspending device for screwdrivers has a suspending rod and multiple sliders. The suspending rod has two holes defined through the suspending rod respectively near two ends of the suspending rod. The sliders are slidably attached to the suspending rod. Each slider has a holder, two clamping arms and a holding bore. The clamping arms respectively extend from a top edge and a bottom edge of the holder and respectively engage with the top edge and the bottom edge of the supporting rod. The holding bore is longitudinally defined through the holder to hold a shank of a screwdriver.

Other objects, advantages and novel features of the invention will become more apparent from the following detailed description when taken in conjunction with the accompanying drawings.

DETAILED DESCRIPTION OF PREFERRED EMBODIMENT

Figure 1:
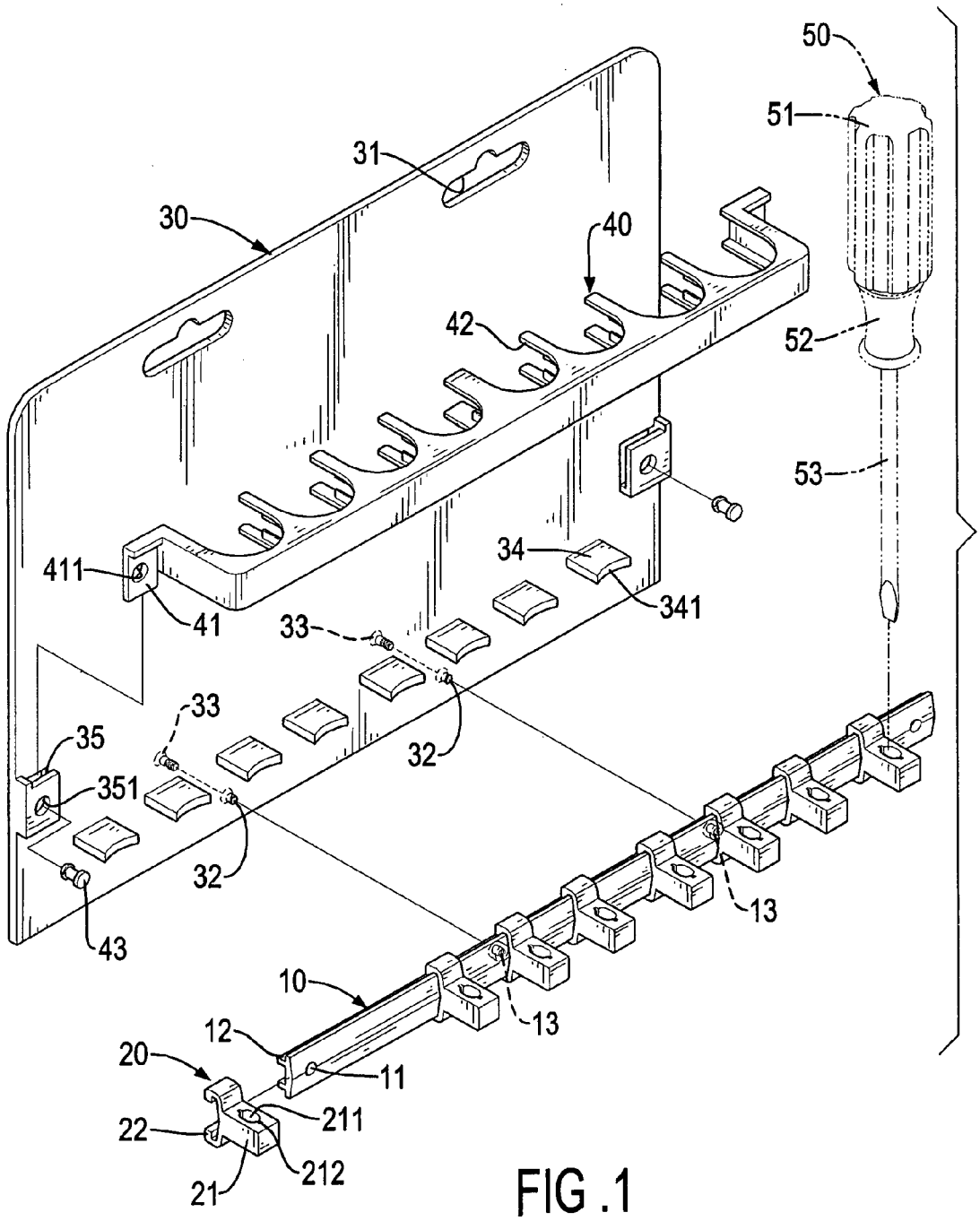
FIG. 1 is an exploded perspective view of a first embodiment of a suspending device in accordance with the present invention.

With reference to FIG. 1, a suspending device for screwdrivers in accordance with the present invention comprises a suspending rod (10), multiple sliders (20), an optional suspending panel (30) and an optional holding bar (40).

The suspending rod (10) has two holes (11) defined through the suspending rod (10) and respectively near two ends of the suspending rod (10). Two rails (12) are formed on the suspending rod (10) in parallel.

The sliders (20) are slidably attached to the suspending rod (10) and each has a holder (21), two clamping arms (22) and a holding bore (211). The clamping arms (22) respectively extend from top edge and bottom edge of the holder (21) and respectively engage with top edge and bottom edge of the supporting rod (10). In an optional embodiment, the clamping arms (22) are formed as an upper one and a lower one with the latter having an L-shaped cross-section and the former having an inverted L-shaped cross section, and a distal end of each arm (22) slidably engages with the respective rail (12) of the suspending rod (10). The holding bore (211) is uprightly defined through the holder (21) to hold a shank (53) of a screwdriver (50). In addition, the holding bore (211) in each slider (20) may be elongated and have an inner surface and two slots (212) defined in the inner surface of a periphery defining the holding bore (211) and longitudinally extending from the top edge to the bottom edge of the holder, and each slot (212) having an opening facing to each other.

Accordingly, multiple screwdrivers (50) can be inserted respectively into the holding bores (211) in the sliders (20) to make the screwdrivers (50) held on the suspending rod (10). The slots (212) in each slider (20) can provide a guide effect to the tip of the corresponding screwdriver (50). With the shape of the elongated holding bores (211), the shanks of the screwdrivers (50) can be securely held. With the arrangement of the holes (11) in the suspending rod (10), the suspending rod (10) with the sliders (20) and the screwdriver (50) can be hung on a wall or a display panel with hangers, for example hooks. Because the sliders (20) are slidable relative to the suspending rod (10), the distance between adjacent sliders (20) is adjustable to fit with different types of screwdrivers (50). Therefore, the use of the suspending device in accordance with the present invention is convenient and versatile.

Figure 2:
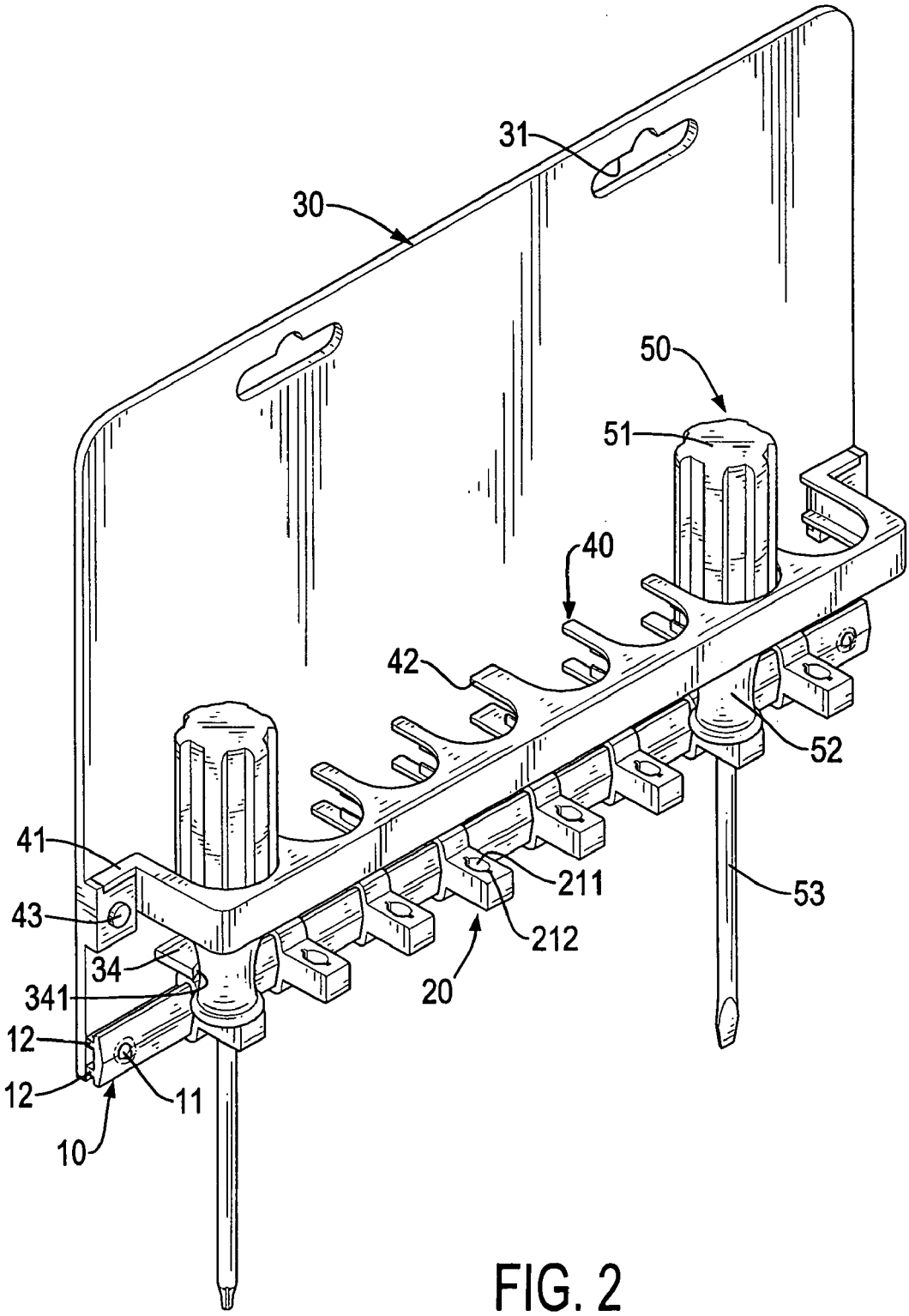
FIG. 2 is a perspective view of the suspending device in FIG. 1 with multiple screwdrivers held on the suspending device.
Figure 3:
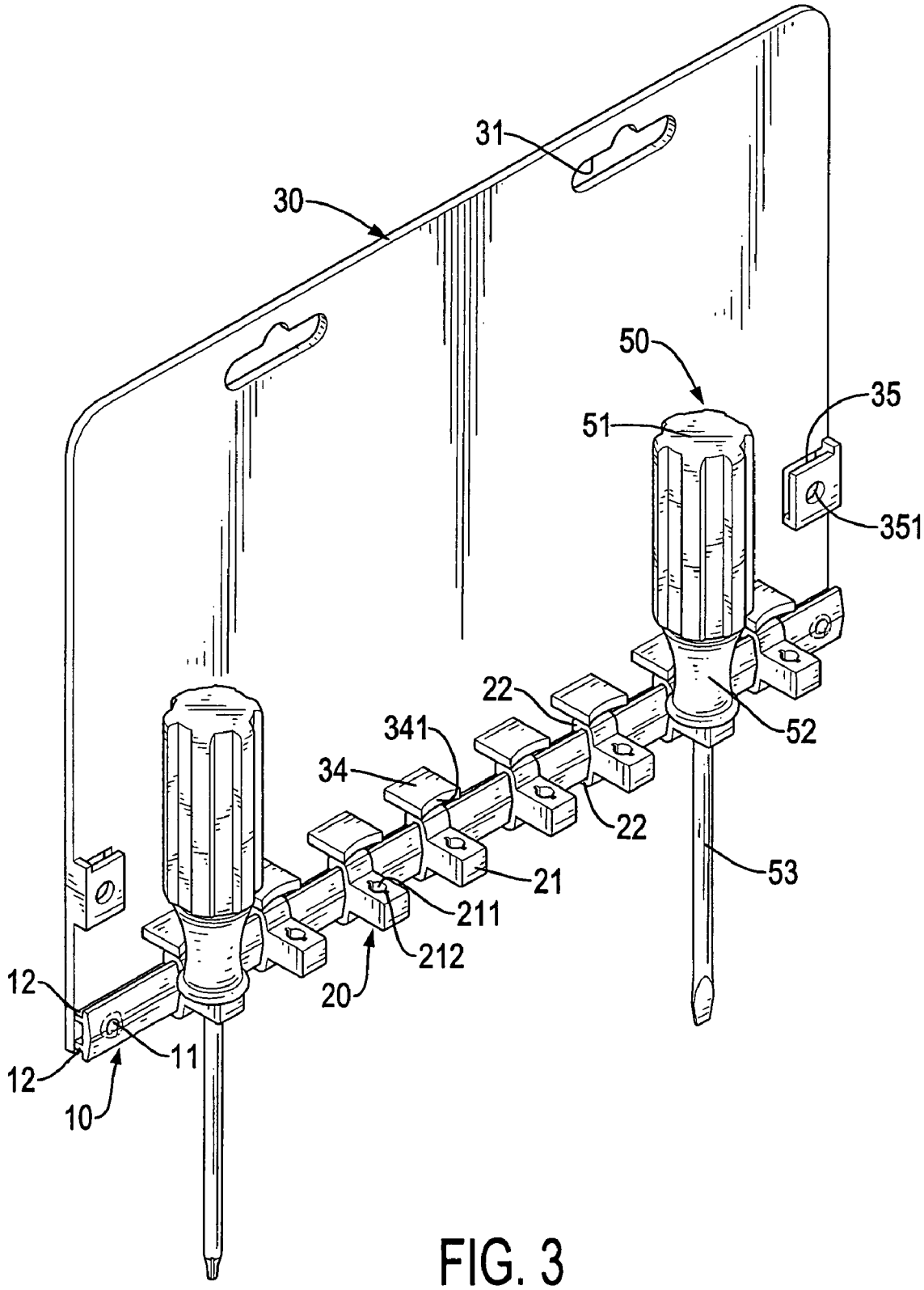
FIG. 3 is a perspective view of the suspending device in FIG. 1 showing that the holding bar is detached from the suspending panel.

With further reference to FIG. 2, the suspending panel (30) on which the suspending rod (10) is detachably attached has at least one suspending top hole (31) defined through the suspending panel (30). With the suspending panel (30), the suspending rod (10) with the sliders (20) and screwdrivers (50) can be hung on a wall or a display panel with hangers hooked onto the suspending top holes (31). To attach the suspending rod (10) onto the suspending panel (30), the suspending rod (10) has multiple threaded holes (13), and the suspending panel (30) has multiple through holes (32) aligning respectively with the threaded holes (13) in the suspending rod (10). Multiple screws (33) extend respectively through the through holes (32) in the suspending panel (30) and are screwed respectively into the threaded holes (13) in the suspending rod (10) to detachably attach the suspending rod (10) to the suspending panel (30).

In addition, the suspending panel (30) further has multiple tabs (34) extending from the suspending panel (30), corresponding respectively to the sliders (20) on the suspending rod (10) and adapted to abut necks (52) of screwdrivers (50). In a preferred embodiment, each tab (34) has a concave free end (341) to fit with the neck (52) of the corresponding screwdriver (50). The tabs (34) can provide a further supporting effect to the screwdrivers (50).

The holding bar (40) is detachably attached to the suspending panel (30) above the tabs (34), corresponds to the suspending rod (10) and comprises multiple holding recesses (42). The holding recesses (42) are defined in the holding bar (40) and correspond respectively to the sliders (20) on the suspending rod (10) to hold the grips (51) of the screwdrivers (50). To detachably attach the holding bar (40) to the suspending panel (30), the suspending panel (30) has two locking slots (35) and two locking holes (351) communicating respectively with the locking slots (35). The holding bar (40) has two ears (41) longitudinally extending from two ends of the holding bar (40) and extending respectively into the locking slots (35) in the suspending panel (30). Each ear (41) has a locking hole (411) aligning with one of the locking holes (351) in the suspending panel (30) when the ear (41) is inserted into the corresponding locking slot (35). Two fasteners (43) extend respectively into the locking holes (351) in the suspending panel (30) and through locking holes (411) in the ears (41) and the locking slots (35) in the suspending panel (30) to attach the holding bar (40) to the suspending panel (30).

With the arrangement of the holding bar (40), the screwdrivers (50) can be securely held on the suspending device, and the screwdrivers (50) will not be detached from the suspending rod (10) until the holding bar (40) is removed from the suspending panel (30) so that a thief-proof effect is provided.

Figure 4:
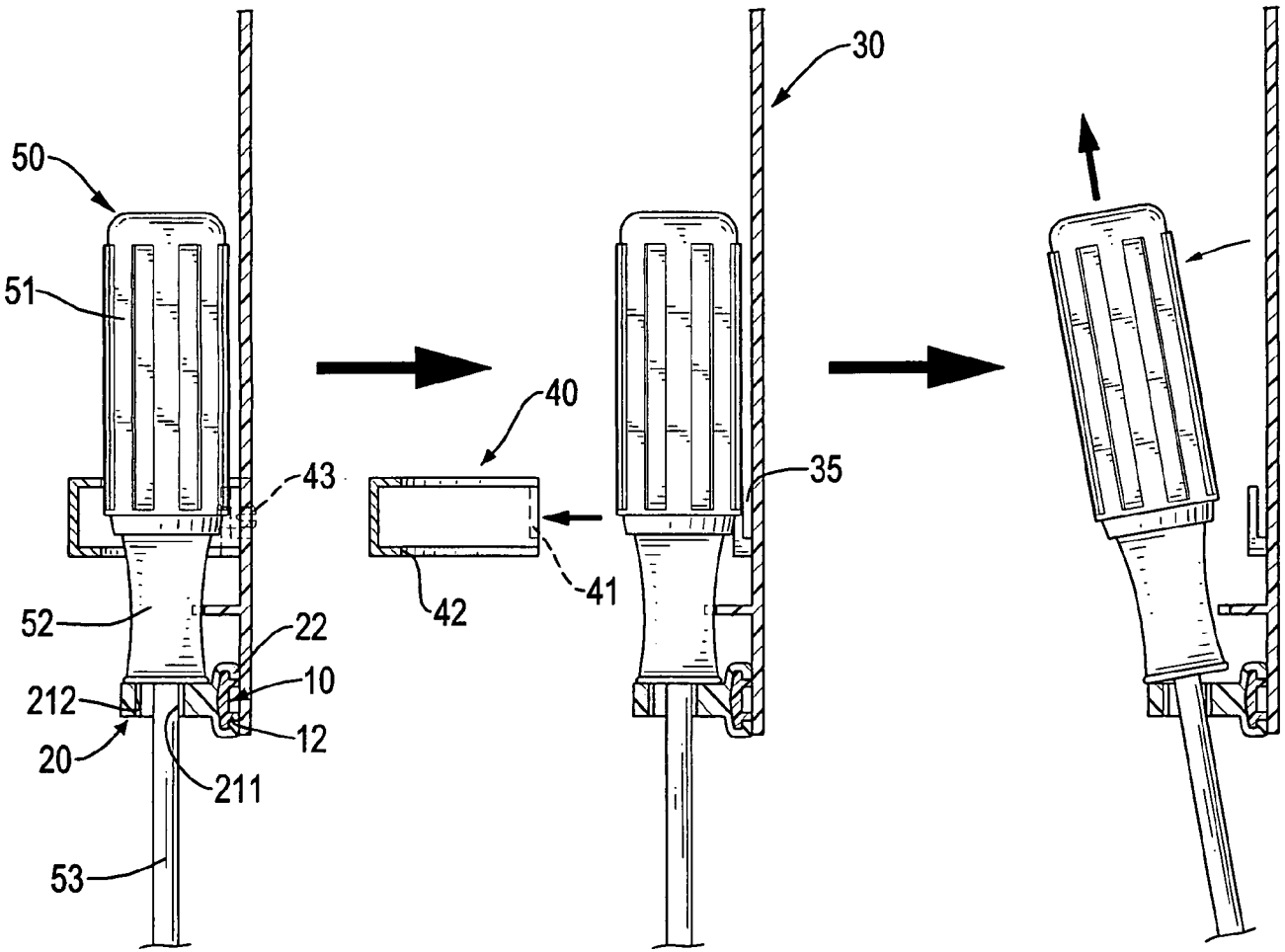
FIG. 4 shows operational side plan views in partial cross section of the suspending device in FIG. 1 showing the processes of detaching a screwdriver from the suspending device.

To detach the screwdrivers (50) from the suspending device for use, with further reference to FIG. 4, the fasteners (43) are firstly released from the suspending panel (30) so that the holding bar (40) can be removed from the suspending panel (30). Consequently, the screwdrivers (50) can be taken out from the holding bores (211) in the sliders (20) for use. Moreover, the suspending rod (10) with the sliders (20) can be detached from the suspending panel (30) and hung on a wall or a display panel individually after unscrewing the screws (33) from the threaded holes (13) in the suspending rod (10).

Figure 5:
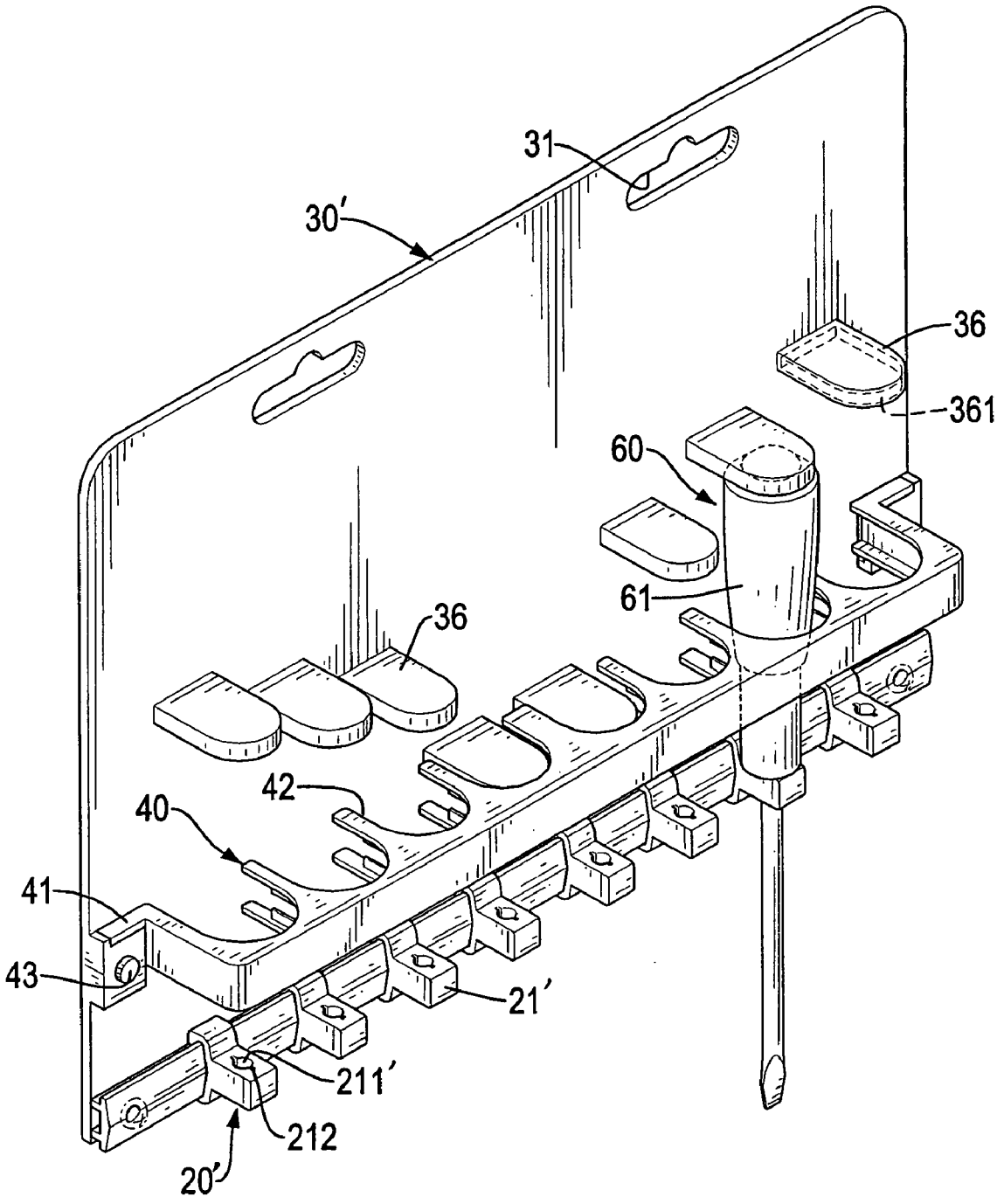
FIG. 5 is a perspective view of a second embodiment of a suspending device in accordance with the present invention.
Figure 6:
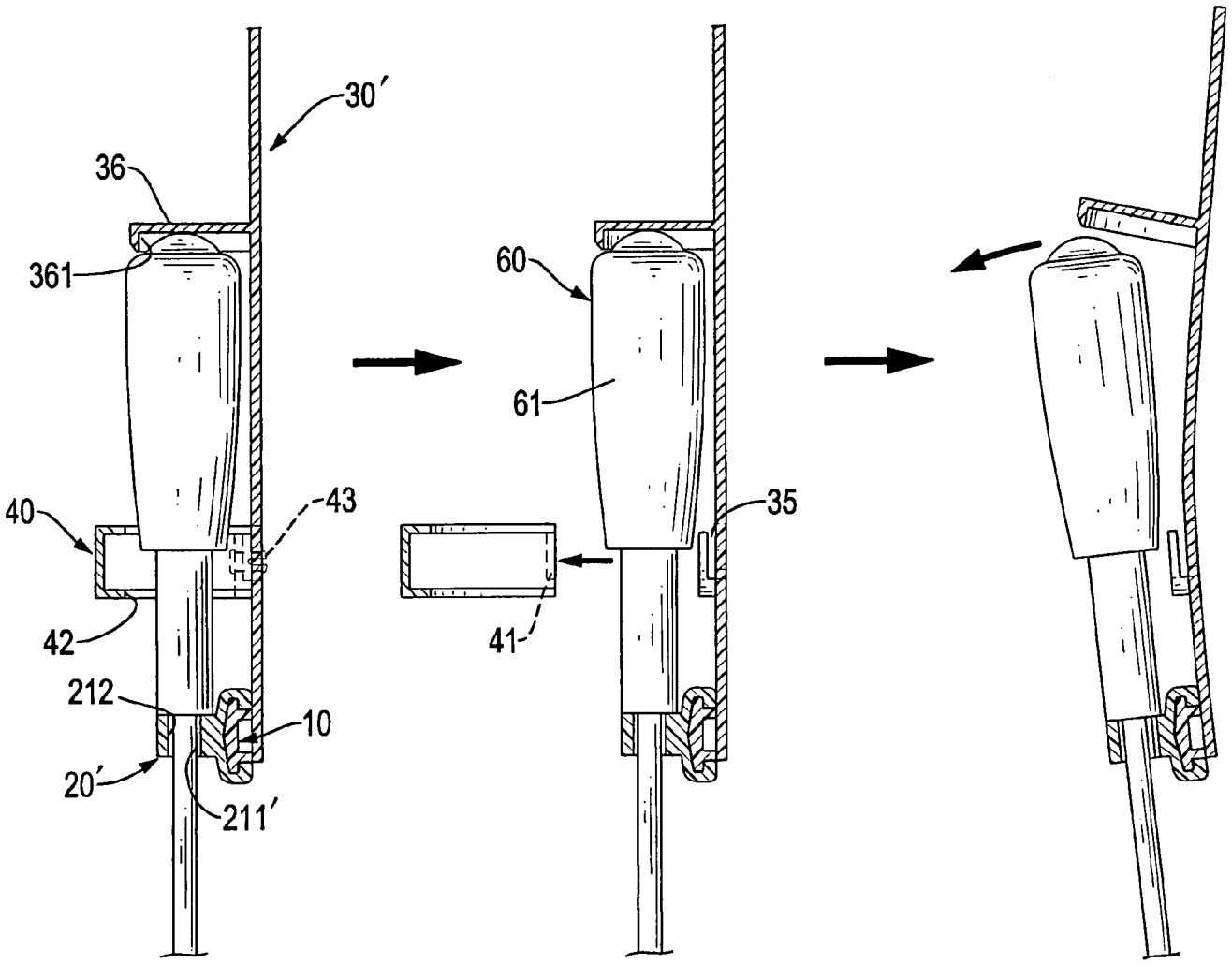
FIG. 6 shows side plan views in partial cross section of the suspending device in FIG. 5 showing the processes of detaching a screwdriver from the suspending device.

With reference to FIGS. 5 and 6, the suspending panel (30') may have multiple holding caps (36) extending from the suspending panel (30') at a location above the holding bar (40), corresponding respectively to the sliders (20) on the suspending rod (10) and adapted to abut grips (61) of screwdrivers (60). Each holding cap (36) has a cavity defined in the bottom of the cap (36) to hold the end of the grip (61) of the corresponding screwdriver (60) inside. The holding caps (36) can be located at different heights relative to the holding bar (40) to respectively hold the grips (61) of different types of screwdrivers (60). The holding bores (211') in holders (21') of the sliders (20') may be round holes.

With the arrangement of the holding caps (36), the screwdrivers (60) will not be removable from the suspending device until the holding bar (40) is detached from the suspending panel (30'), such that a thief-proof effect is provided.

To take the screwdrivers (60) out for use from the suspending device, the holding bar (40) is firstly removed from the suspending panel (30') by means of releasing the fasteners (43). The suspending panel (30') is slightly bent to define a gap between each holding cap (36) and the corresponding screwdriver (60), such that the screwdrivers (60) can be taken out from the holding bores (211') in the sliders (20').

With such a suspending device in accordance with the present invention, the manufacturer can change the amount of sliders (20,20') mounted on the suspending rod (10) and the distance between adjacent sliders (20,20') to fit with different type of screwdrivers (50,60). Therefore, to manufacture different suspending devices for different types of screwdrivers (50,60) is easy and convenient, and the cost for manufacturing suspending devices is lowered relative to the prior art.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A suspending device for screwdrivers comprising:

a suspending rod having a top edge, a bottom edge and two holes defined through the suspending rod respectively near two ends of the suspending rod; and multiple sliders slidably attached to the suspending rod and each having a holder having a top edge and a bottom edge;

two clamping arms respectively extending from the top edge and the bottom edge of the holder and respectively engaging with the top edge and the bottom edge of the supporting rod;

a holding bore defined through the holder to hold a shank of a screwdriver, defined by an inner periphery and having two slots defined in the inner periphery of the holding bore and longitudinally extending from the top edge to the bottom edge of the holder, and each slot having an opening in communication with the holding bore and facing to each other; and a suspending panel on which the suspending rod is detachably attached having at least one suspending hole defined through the suspending panel, wherein the suspending panel comprises a holding bar detachably attached to the suspending panel, corresponding to the suspending rod and comprising multiple holding recesses defined in the holding bar and corresponding respectively to the sliders on the suspending rod; and multiple tabs extending from the suspending panel between the suspending rod and the holding bar and corresponding respectively to the sliders on the suspending rod, and each tab having a fixed, non-concave end attached to the suspending panel, and a concave free end opposite to the suspending panel and adapted to hold a neck of a screwdriver; and two locking slots and two locking holes communicating respectively with the locking slots;

the holding bar further has two ears extending respectively from two ends of the holding bar and extending respectively into the locking slots in the suspending panel; and two fasteners extending respectively into the locking holes and through the ears on the holding bar and the locking slots in the suspending panel to detachably attach the holding bar to the suspending panel.

2. The suspending device as claimed in claim 1, wherein the suspending rod further has multiple threaded holes;

the suspending panel has multiple through holes aligning respectively with the threaded holes in the suspending rod; and multiple screws extending respectively through the through holes in the suspending panel and screwed respectively into the threaded holes in the suspending rod to detachably attach the suspending rod to the suspending panel.

3. The suspending device as claimed in claim 2, wherein the suspending rod further has two rails formed on the suspending rod in parallel; and an upper one of the clamping arms on each slider has an inverted L-shaped cross-section and a lower one of the clamping arms on each slider has an L-shaped cross-section, and a distal end of each clamping arm slidably engages with a respective one of the rails on the suspending rod.

* * * * *